US006499708B1

(12) United States Patent
Cowen

(10) Patent No.: US 6,499,708 B1
(45) Date of Patent: Dec. 31, 2002

(54) DECORATIVE DRAPERY RODS

(76) Inventor: Joan Cowen, 5 N. Kingswood Dr., St. Charles, IL (US) 60175

( * ) Notice: Subject to any disclaimer, the term of this patent is extended or adjusted under 35 U.S.C. 154(b) by 0 days.

(21) Appl. No.: 09/393,536

(22) Filed: Sep. 10, 1999

(51) Int. Cl.[7] ..... A47H 1/10

(52) U.S. Cl. ..... 248/261; 248/262; 16/87.2; 16/87.42 R

(58) Field of Search ..... 211/105.1; D8/376; 248/261, 262, 266; 16/87.4 R, 87.4 W, 93 D, 87.2

(56) References Cited

U.S. PATENT DOCUMENTS

| | | | | | |
|---|---|---|---|---|---|
| 349,525 | A | * | 9/1886 | Scottron | 248/261 X |
| 444,230 | A | | 1/1891 | Strauss | |
| 548,192 | A | * | 10/1895 | Groth | 16/87.4 W |
| 675,224 | A | | 5/1901 | Kober | |
| 869,328 | A | * | 10/1907 | Pearson | 248/262 |
| 934,475 | A | | 9/1909 | Taussig | |
| 1,032,265 | A | | 7/1912 | Anderson | |
| 1,877,984 | A | | 9/1932 | Schmidt | |
| 2,219,075 | A | | 10/1940 | Le Veau | |
| 2,256,008 | A | | 9/1941 | Armstrong | |
| 2,538,755 | A | | 1/1951 | Bradley | |
| 2,812,534 | A | | 11/1957 | Graber | |
| 2,872,696 | A | | 2/1959 | Perimutter | |
| 2,936,524 | A | | 5/1960 | Shaffer | |
| 3,119,442 | A | * | 1/1964 | Ford | 248/262 X |
| 3,164,352 | A | | 1/1965 | Weaver | |
| 3,286,299 | A | | 11/1966 | Golden | |
| 3,358,319 | A | | 12/1967 | Hillenbrand | |
| 3,378,879 | A | | 4/1968 | Stall | |
| 3,688,341 | A | | 9/1972 | Peckham | |
| 3,730,249 | A | | 5/1973 | Hess | |
| 3,766,597 | A | | 10/1973 | Ford | |
| 3,881,218 | A | | 5/1975 | Palmer | |
| 3,916,975 | A | | 11/1975 | Lawson | |
| 4,031,943 | A | | 6/1977 | Silvestre | |
| 4,126,921 | A | | 11/1978 | Pape | |
| 4,141,105 | A | | 2/1979 | Gonon | |
| 4,190,927 | A | * | 3/1980 | Hepperle | 16/96 D |
| 5,024,481 | A | * | 6/1991 | Swersky | 296/180.1 |
| 5,259,520 | A | | 11/1993 | Roggio | |
| 5,421,059 | A | | 6/1995 | Leffers | |
| 5,426,821 | A | * | 6/1995 | Story | 16/87.4 R |
| 5,535,897 | A | * | 7/1996 | Gobidas | 16/95 W |
| 5,670,221 | A | * | 9/1997 | Bried et al. | 160/314 |
| 6,260,600 | B1 | * | 7/2001 | Miller | 160/38 |

FOREIGN PATENT DOCUMENTS

| | | |
|---|---|---|
| DE | 846446 | 7/1949 |
| EP | 0235054 A1 | 9/1987 |
| FR | 1329827 | 12/1963 |
| GB | 1427623 | 3/1976 |

OTHER PUBLICATIONS

Oatey, a J–Hook for use in supporting pipe systems. (no date).

* cited by examiner

*Primary Examiner*—Korie Chan
*Assistant Examiner*—Gwendolyn Baxter
(74) *Attorney, Agent, or Firm*—Robert L. Marsh

(57) ABSTRACT

A functional drapery rod suitable for receiving artistic material is made from a cylindrical member such as a wood rod or PVC. A grove is made longitudinally in the surface of the rod into which a track is fitted. Drapery is supported by decorative members such as rings which are attached to slides moveable along the track. The rod is retained by support members and connectors on the support members and on the rod prevent rotation of the rod in the supports.

5 Claims, 5 Drawing Sheets

FIG. 7
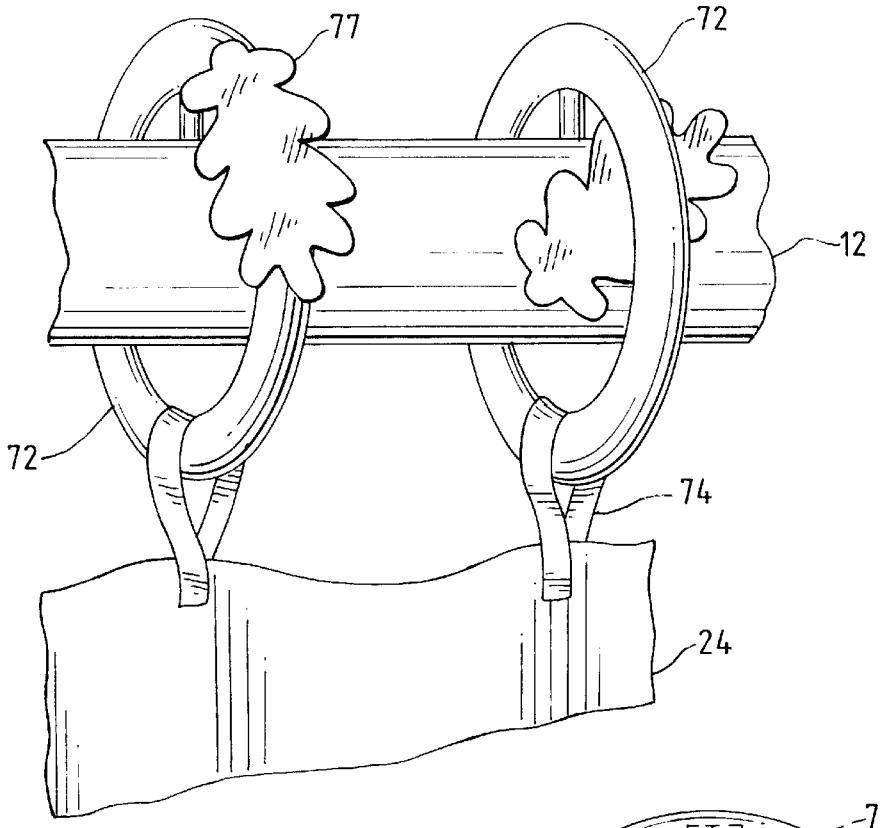
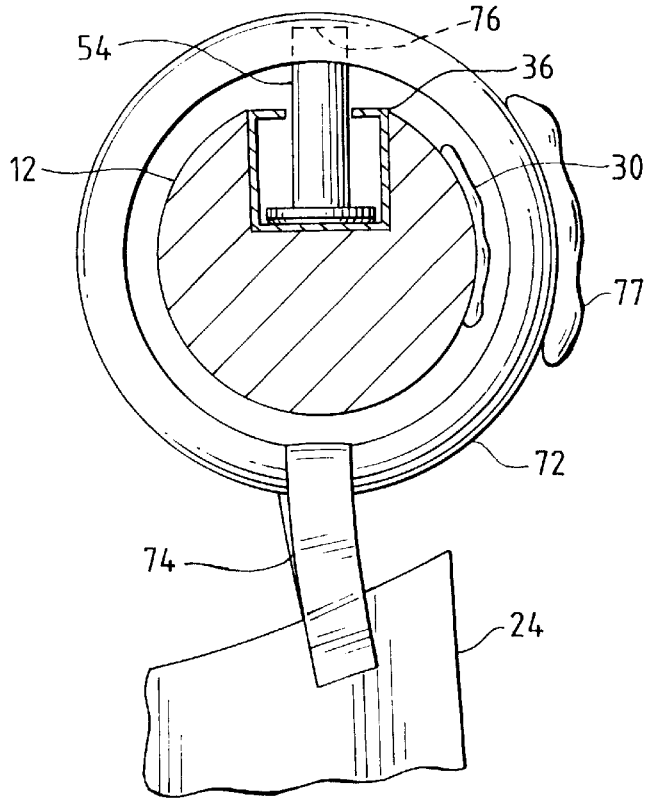
FIG. 8

FIG. 9
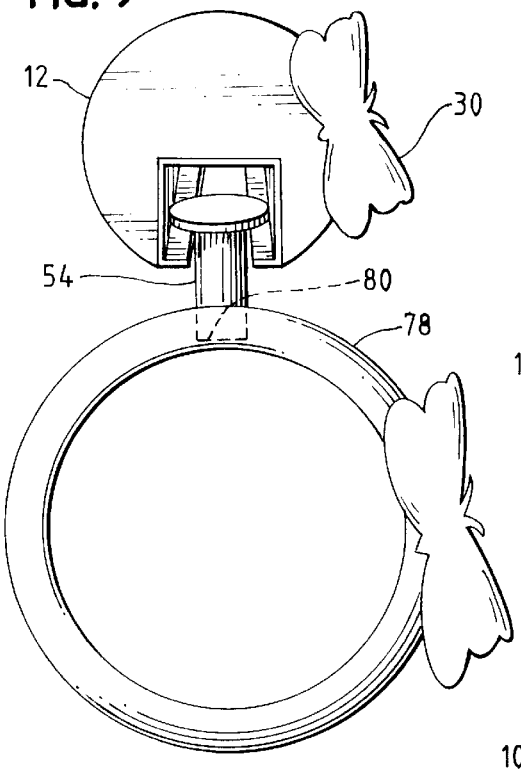
FIG. 10
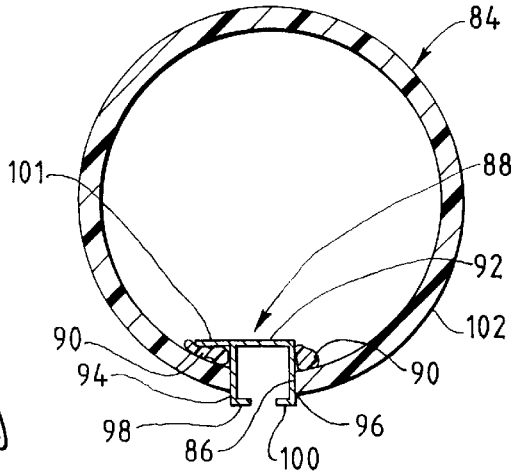
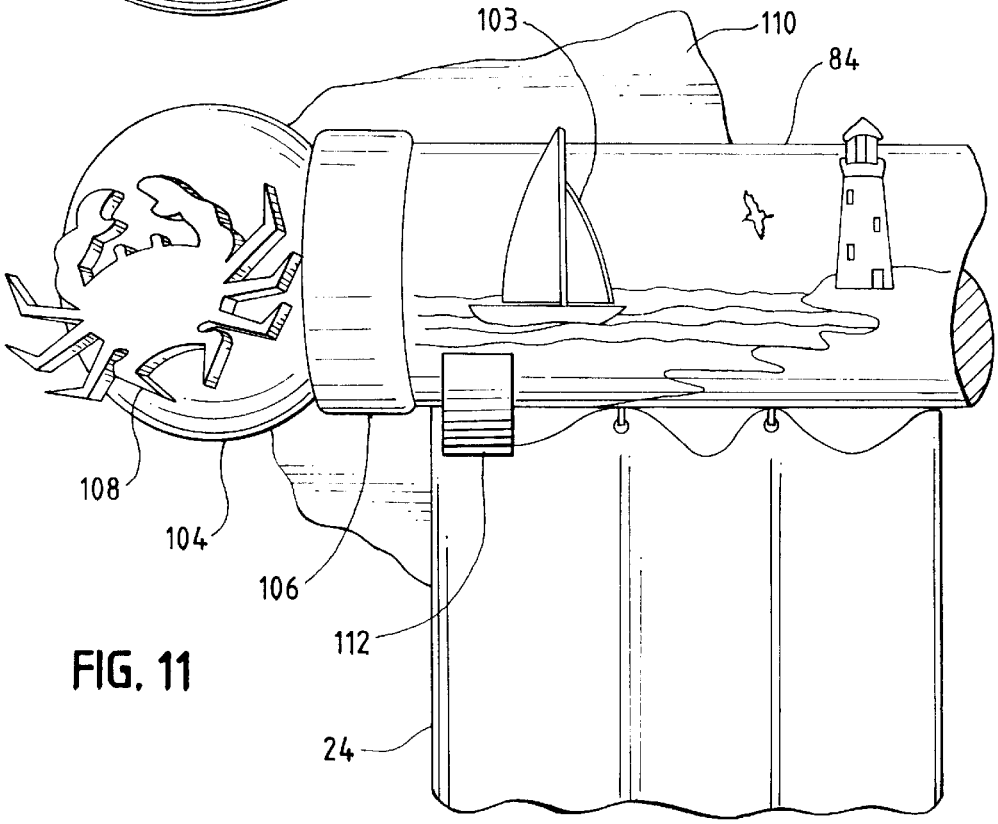
FIG. 11

DECORATIVE DRAPERY RODS

The present invention relates to cylindrical drapery rods having a decorated surface and, in particular, to a functional rod on which drapery is supported by moveable support members that can be moved from an open condition to a closed condition.

BACKGROUND OF THE INVENTION

Traditionally, curtains and draperies provide the function of controlling light passing through a window. The drapery may be opened to allow the light of a sunny day to illuminate the room or may be closed to provide privacy to the occupants thereof. A functional drapery rod is an elongate member having one or more tracks thereon for receiving a plurality of support members to which the upper ends of the drapery is attached. The support members move within the tracks to allow the drapery to be moved between an open condition, in which light is emitted to the room, and a closed condition in which the drapery provides privacy for the occupants.

The drapery within a room also contributes to the decoration thereof and it has become common for interior designers to sacrifice the functional purpose of such drapery in favor of their decorative qualities. Wooden rods are available having diameters of ⅞ inch or more with outer surfaces which are smooth, carved to give a fluted appearance, or curved to give a spiral rope appearance.

These rods can be made functional by positioning wooden rings around the rod and suspending the drapery from the wooden rings. A wand is usually provided for moving the rings along the rod to thereby open or close the drapery.

The attractiveness of such wooden rods can be further enhanced by artistically painting the surfaces thereof to depict a scene or colorful design, or by applying clay relief to the rod to give a three dimensional quality to the designs thereon. When the surface of the rod is artistically painted, or when clay relief is applied to the surface, wooden rings cannot be used to move the drapery along the rod because the rings would damage the artistry applied to the surface thereof. Wooden rods with artistically decorated surfaces are, therefore, nonfunctional and blinds must be provided behind the drapery to control the light passing through the window. Where the blinds are installed so as to be visible behind the wood rod, the blinds detract from the appearance of the room.

It would be desirable to provide, therefore, a curtain rod, the outer surface of which could receive decorative material and which would allow movement of the drapery supported thereby from an open condition to a closed position without damaging or destroying the decoration on the rod.

SUMMARY OF THE INVENTION

Briefly, the present invention is embodied in an elongate cylindrical drapery rod for supporting drapery and the like. The rod has an outer surface having a longitudinal slot therein for receiving a metal track. The drapery is supported by a plurality of slides which are moveable within the track such that decorative material on the outer surface of the rod will not be damaged by movement of the drapery.

In the preferred embodiment, where the rod has a diameter of three inches or less, the rod may be made of wood. Wood is a heavy material, however, and where a rod with a diameter of greater than three inches is desired, the rod should be made of a lighter material. The plastic piping used for plumbing and commonly known as PVC is light weight, inexpensive, the surface thereof is suitable for receiving the paints and clay relief needed to decorate the surfaces thereof, and fittings and attachments are readily available to facilitate its use. Where PVC is employed, an elongate slot is cut in the outer surface of the PVC into which a metal track is retained by a suitable adhesive.

The rod may be used in a number or orientations. When the track is positioned along the upper surface of the rod, cylindrical loops with slides positioned along the inner surface of the loops may be fitted around the rod for movement along the rod without contacting the surface thereof. When the rod is oriented with the track along the lower surface thereof, the drapery may be suspended from slides depending from the track. The rod may also be oriented with the track directed towards the window, so that it is not visible from within the room. In this orientation, the drapery is attached with hooks to the slides which move along the back side of the rod as viewed from the room. Wooden rings such as sold by Kirsch, Incorporated, Sturgis, Mich. 49091 as their parts number 5402 and 5602 are useable in this regard.

Cylindrical drapery rods are supported by support members which extend from the wall and have an arcuate upper surface for supporting for the rod. Where the rod is to be positioned in the support with the track extending along the upper surface thereof, or with the track extending along the rear surface thereof, the weight the drapery may apply a rotational force to the rod. To prevent rotation of the rod within the support members, a strip of attachment material is applied to the arcuate surface of the support member and a complimentary strip of attachment material is applied to the outer surface of the rod and positioned so as to engage the attachment material on the support member. When the rod is assembled to the supports with the strips of attachment material engaging each other, and the rod will not rotate. In the preferred embodiment, the strips of attachment material are hook and loop type attachments such as sold under the trademark VELCRO.

BRIEF DESCRIPTION OF THE DRAWINGS

A better and more complete understanding of the present invention will be had after a reading of the following detailed description taken in conjunction with the drawings where:

FIG. 7 is a fragmentary enlarged isometric view of the rod shown in FIG. 1 with wooden rings fitted around its circumference;

FIG. 8 is an end view of the rod and rings shown in FIG. 7;

FIG. 9 is an end view of another rod having wooden rings supported in a track extending along the bottom of the rod;

FIG. 10 is an end view of a PVC rod with a track therein;

FIG. 11 is a fragmentary isometric front elevational view of a PVC rod with a finial;

DETAILED DESCRIPTION OF THE PREFERRED EMBODIMENT

Figure 1:
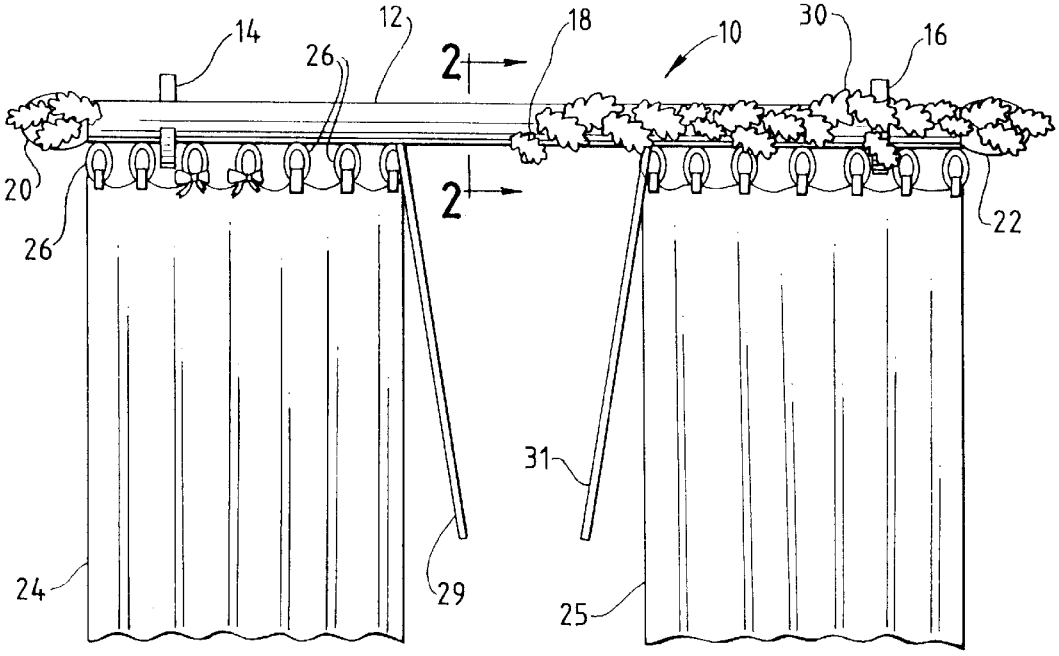
FIG. 1 is a front elevational view of a drapery rod in accordance with the present invention with three dimensional decorations visible on the outer surface thereof.

Referring to FIG. 1, a drapery rod 10 includes an elongate cylindrical member 12 which is retained by a pair of end supports 14, 16, a center support 18, and at the outer ends of which are a pair of decorative finials 20, 22. Suspended below the cylindrical member 12 are a pair of draperies 24, 25, the upper ends of which are retained by a plurality of wooden rings 26 to a corresponding number of metal hooks 28, visible in FIG. 2. Movement of the draperies 24, 25 along the rod 12 is controlled by a pair of wands 29, 31 the upper ends of which engage the draperies 24, 25 or the rings 26 using methods known in the art. To enhance the attractiveness of the drapery rod 10, the outer surface of the cylindrical member 12 is decorated as desired, using paints, three dimensional decorations 30 as shown, or any combination thereof.

Figure 2:
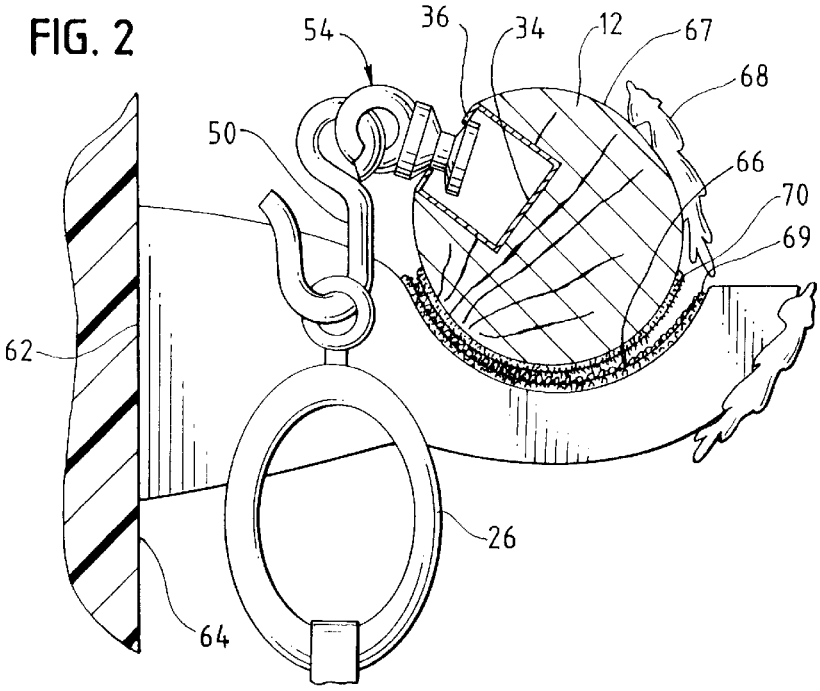
FIG. 2 is an enlarged cross sectional view of the rod shown in FIG. 1 taken through line 2—2 of FIG. 1.

Referring to FIG. 2, the elongate member cylindrical member 12 may be a wooden curtain rod of the type which is presently commercially available through a number of manufacturers. Kirsch Incorporated, for example, produces wooden drapery rods in the form of plain cylindrical polls, fluted polls having a plurality of longitudinal grooves cut into the surface thereof, and rope polls having a spiral pattern around the outer surface to give the appearance of being wrapped with rope or the like. In accordance with the invention, an elongate groove 34 is cut into the length of the rod 12 which is inserted an elongate track 36.

Figure 3:
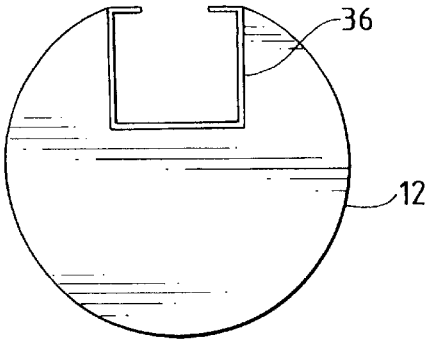
FIG. 3 is an unadorned end view of a length of rod of the type shown in FIG. 1.
Figure 4:
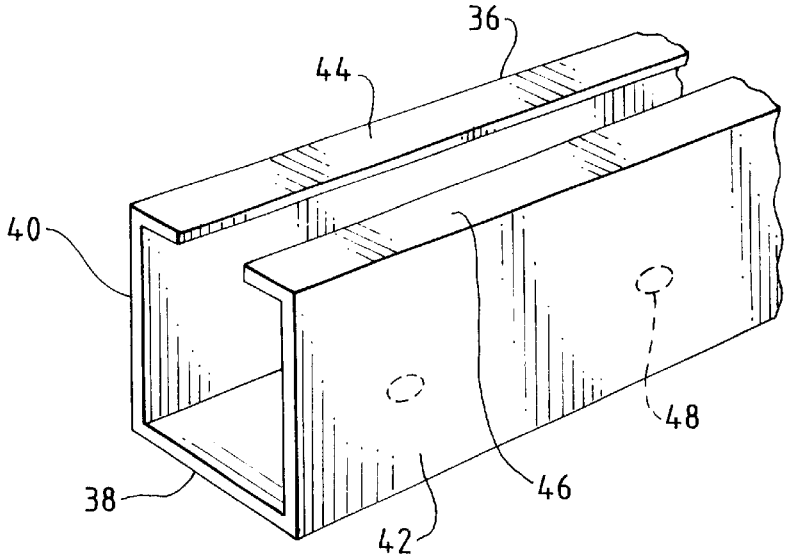
FIG. 4 is a fragmentary isometric view of a length of track suitable for use in the rod shown in FIG. 1.
Figure 5:
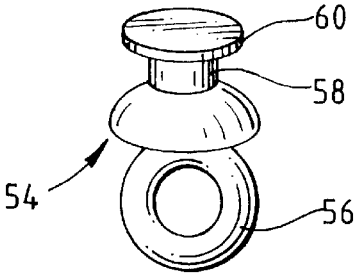
FIG. 5 is an isometric view of a slide for use in the track shown in FIG. 4.

Referring to FIGS. 2, 3, and 4, a suitable track 36 is made of metal, such as aluminum, and has a planar elongate back 38 with parallel sides to which connect parallel side members 40, 42 and at the outer ends of the side members 40, 42 are lips 44, 46 respectively. The track 36 may be retained in the groove 34 of the rod 12 by screws, not shown, extending through a plurality of apertures 48 on the back 38 or by a suitable adhesive, not shown. An extruded aluminum track suitable for use with the present invention is sold by Kirsch, Incorporated as part numbers 9046-12 and 9046-16. To retain the Kirsch product within the wooden rod 12, the groove 34 should have a width of ⅝" and a depth of ½".

Figure 6:
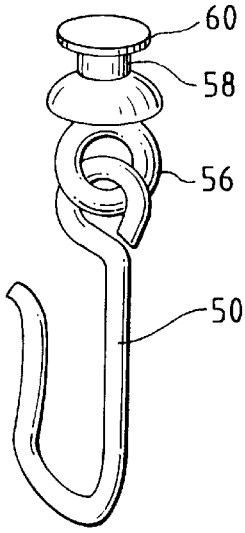
FIG. 6 is an isometric view of a second slide having a hook attached thereto.

Referring to FIGS. 1–6, the plurality of rings 26 are retained to the rod 12 by a corresponding plurality of slides 54 having an elongate body with a loop 56 at one end, a centrally located neck 58 and a bulbous second end 60. The diameter of the neck 58 is less than the distance between the outer ends of lips 44, 46 of the track 36, and the bulbous second end 60 has a width that is larger than the distance between the lips 44, 46 such that the slide 54 is retained in the track 36 and is slideable along the length thereof. A suitable slide 54 is sold by Kirsch, Incorporated as part 9670-1. As shown in FIGS. 2 and 6, the slide 54 is available with a metal hook 50 attached to the loop 56 thereof, and the hook 50 is suitable for retaining a wooden ring 26 or any other decorative attachment to the upper ends of the drapery 24, 25.

Referring to FIG. 2, each of the end supports 14 has a planar mounting portion 62 adapted for mounting on a wall 64 and mounting holes, not shown, through which retaining screws, not shown, are fitted and an arcuate upper support portion 66 shaped to receive the cylindrical outer surface of the rod 12. When the rod 12 is oriented in the supports 14, 16 with the track 36 directed upwardly and toward the wall 64 as shown, the track 36, the slides 54, and the hooks 50 will not be visible from the interior of the room. The outer surface 67 of rod 12 can be decorated with paint and with three dimensional clay structures 68, and the decorations will not be damaged by the movement of the draperies 24, 25 on the slides 54.

When the rod 12 is oriented as shown in FIG. 2, the weight of the draperies 24, 25 will apply a torque to the rod 12 which may cause the rod 12 to rotate within the supports 14. To prevent rotation of the rod 12 within the supports 14, a first connected strip 69 is applied to the arcuate support portion 66 of the support 14 and a second connective strip 70 is applied around the outer surface 67 of the rod 12 such that the strips 69, 70 will engage each other when the rod 12 is in the support 14 as shown. In the preferred embodiment, the connective strips 69, 70 are the hook and loop connectors of the type commonly sold under the trademark VELCRO.

Referring to FIGS. 7 and 8, a plurality of wooden rings 72 which fit around the rod 12 to which the draperies 24, 25 are attached by straps 74 are shown. A number of manufacturers provide wooden rings having inner diameters which are suitable for fitting around relief decorated wooden rods having diameters of two or three inches. To adapt the rings 72 for use with the rod 12, a bore 76 is drilled on the inner surface of the rings 72 into which is fitted the loop 56 end of a slide 54 and the parts are retained together by suitable adhesive, not shown. The rod 12 is oriented with the track 36 along the upper surface as shown in FIG. 8 so that the rings 72 can move along the rod without damaging decorative material on the outer surface thereof. The outer surfaces of the rings 72 may also be artistically decorated and may bear clay relief decorations 77 as shown.

It should be appreciated that the inner diameter of the rings 72 must be sufficiently large so as not to contact the outer surface 67 of the rod 12 during the movement of other drapery 24, 25 because such contact will rapidly damage or destroy the artistic material on the rod 12. Where there is clay relief 30 on the rod 12, it is desirable to employ rings 72 having an inner diameter at least 1–½ inches larger than the outer diameter of the rod 12.

Referring to FIG. 9, the rod 12 may also be oriented with the track 36 along the lower surface thereof such that the draperies 24, 25 can be attached to a another set of rings 78 as shown. Kirsch, Incorporated sells rings having a radically outwardly extending slide portion with a neck and bulbous outer end sized to be slideable with the track 36 as part number 5607E. The rings may also be constructed by inserting the loop end 56 of a connector 54 into a bore 80 in the outer circumference of a wooden ring 78.

Referring to FIGS. 10 and 11, it is undesirable to use a wooden rod having a diameter greater than about three inches because of the weight thereof. An inexpensive a rod with a diameter larger than three inches and is not inordinately heavy can be made from a plastic pipe 84 of the type used in the construction industry for plumbing and commonly known as PVC. To employ PVC as a rod 12, a slot 86 is cut through the length of the PVC 84 and a track 88 is retained in the slot by an adhesive 90. Like the track 36, the track 88 has an elongate planar back 92 from which extend parallel sides 94, 96 and at the outer ends of sides 94, 96 are lips 98, 100 such that the track 88 will retain the bulbous ends 60 and necks 58 of the slides 54 previously described. One track product which is well suited for use with PVC is sold by Kirsch, Incorporated as part 94004-12. This product has an elongate extension 101 along one side of the back 92 as shown which is adapted to receive the adhesive 90 as shown.

As with the wooden rod 12, the outer surface 102 of the PVC rod can receive paintings, faux finishes or relief decorations 103. Three dimensional materials may give the appearance of a vine or snake wrapped round the circumference of the rod or portray a train or a boat moving across a scene as shown. Draperies 24, 25 may be attached to slides 54 and moved along the track 88 without damaging the decorative material on the surface thereof.

As shown in FIG. 11, a finial 104 can be made for use with the PVC rod 88. To make a finial 104, a coupling fitting 106 suitable for joining the ends of two lengths of PVC is particularly useful because the coupling fitting 106 will cover the rough cut end of the PVC. A three dimensional relief decoration 108 is then bonded into the opposite end of the coupling fitting 106 to form the finial 104.

Figure 12:
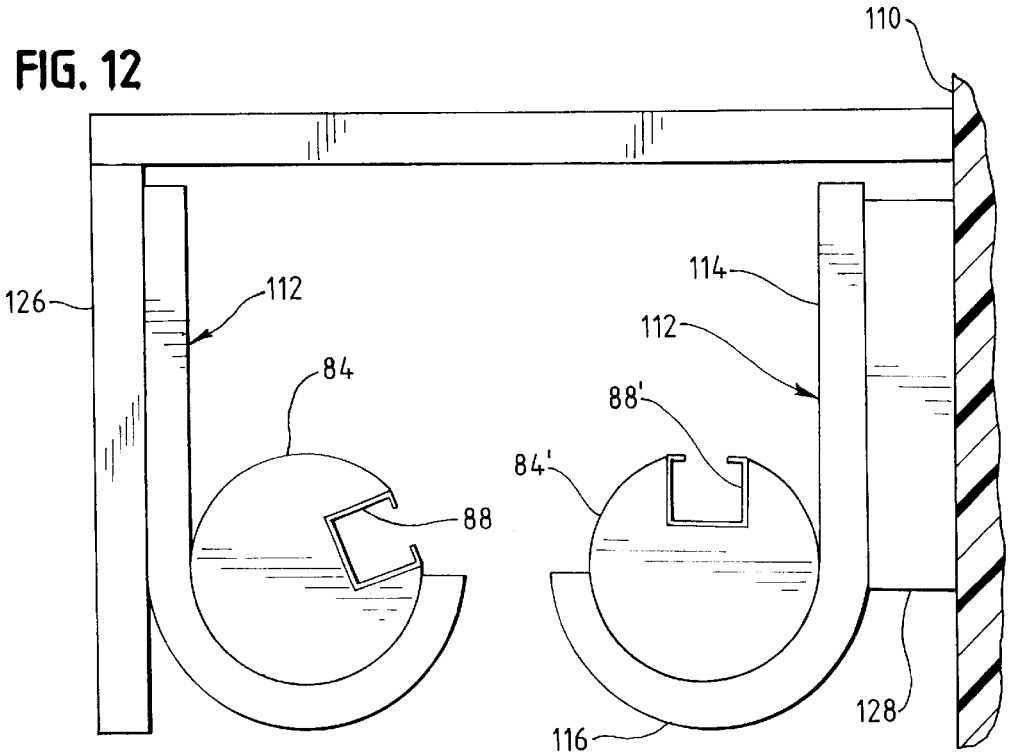
FIG. 12 is an end view of two PVC rods supported by J-hooks under a cornice.
Figure 13:
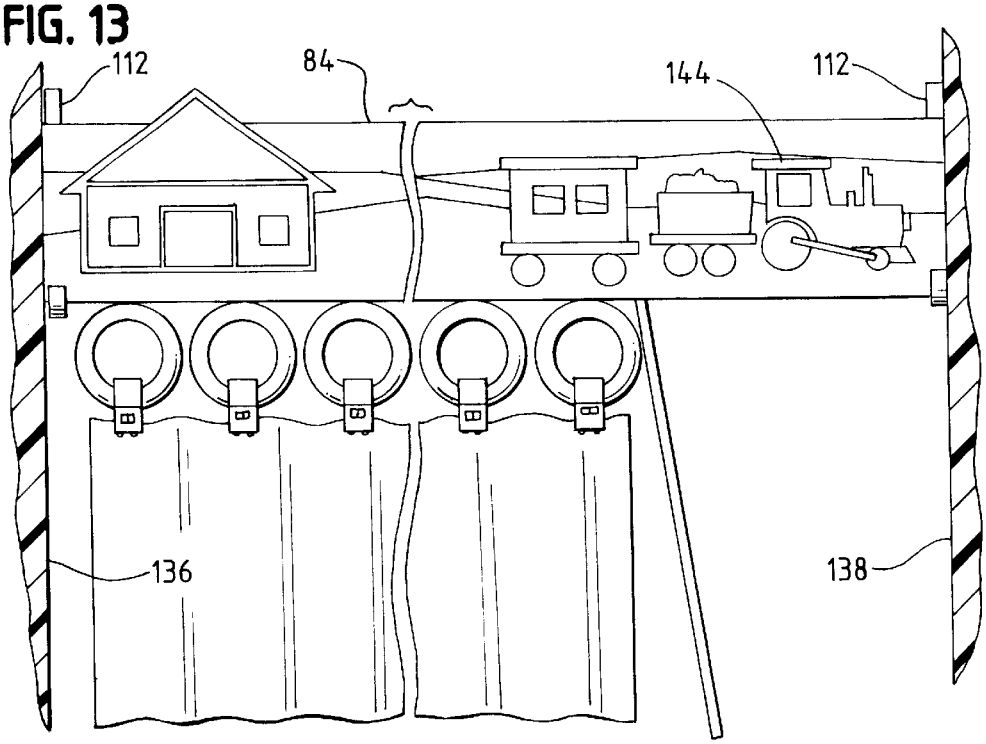
FIG. 13 is a front elevational view of a PVC rod retained between two walls by J-hooks.

Referring to FIGS. 12 and 13, the rod 84 may be retained to a wall 110 by a J-hook 112 of the type commercially available from suppliers of PVC. The J-hook has an elongate upwardly extending mounting portion 114 with a plurality of holes, not shown, therein to facilitate the mounting of the J-hook against a wall, and an accurate support portion 116 in which a length of PVC can be retained. The J-hook may be modified by shortening the length of the mounting portion as needed.

In FIG. 12, two rods 84, 84' are depicted as being supported by J-hooks, the first rod by a set of J-hooks 112 secured to the rear surface of a cornice 126 and the second rod secured by a second set of J-hooks attached with spacers 128 to the wall 110. The first rod 84 is shown as turned so that the track 88 therein cannot be seen from the front. The second rod 84' is positioned along with the track 88' the upper surface thereof and the spacers 128 allow room for rings 72 to be fit around the rod. Connective strips, not shown, on the rods 84, 84' and in the support portions 116 of the J-hooks 112 prevent rotation of the rods as previously described.

FIG. 13 depicts a bath tub curtain rod 84 supported at its ends between walls 136, 138 by a pair of J-hooks 112, the mounting portions 114 of which have been shortened so as to provide an attractive appearance. As shown, the outer surface of the rod 84 is painted and has relief material 144 thereon to depict an attractive scene.

There has therefore been disclosed a drapery rod for which the draperies can be moved with respect to the rod without causing damage to decorative material on the outer surface thereof.

While the present invention has been described with respect to two embodiments, it will be appreciated that many modifications and variations may be made without departing from the true spirit and scope of the invention. It is, therefore, the intention of the appendant claims to cover all such variations and modifications which come within the true spirit and scope of the invention.

What is claimed:

1. The method of making a decorative drapery rod comprising the steps of providing an elongate cylindrical member having a first end, a second end and having an outer surface extending from said first end to said second end, cutting a longitudinal slot in said outer surface of said cylindrical member, providing an elongate track, attaching said track in said slot, applying rigid relief artistic material to said outer surface of said cylindrical member to provide decoration thereto, said rigid relief artistic material applied to said outer surface being free of attachment to both said first end and said second end, providing a support member having a first surface for mounting against a wall and having an arcuate support surface, positioning said cylindrical member in said support member, providing a ring having a diameter greater than a diameter determined by said cylindrical member and said rigid relief artistic material, providing a slide moveable along said track, attaching said ring to said slide, and fitting said ring around said cylindrical member and said rigid relief artistic material with said slide in said track wherein said ring has an inner diameter sufficiently large so as not to interfere with said rigid relief artistic material when said ring is filled around said cylindrical member and said ring is moved along said track.

2. The method of making a decorative drapery rod comprising the steps of providing a length of PVC having a first end, a second end, and having an outer surface extending from said first end to said second end, cutting a longitudinal slot in said outer surface of said PVC, providing an elongate track, providing a slide moveable along said track, attaching said track in said slot, applying rigid relief artistic material to said outer surface of said PVC to provide decoration thereto, said rigid relief artistic material applied to said outer surface being free of attachment to both said first end and said second end, providing a support member having a first surface for mounting against a wall and having an arcuate support surface, positioning said length of PVC in said arcuate support surface with said track oriented to receive said slide, providing means for preventing rotation of said length of PVC with respect to said support member to maintain said orientation of said PVC and said slide with respect to said arcuate support surface, and applying said means for preventing rotation to said outer surface of said PVC and said arcuate support surface, providing a ring having an inner diameter greater than a diameter determined by said length of PVC and said rigid relief artistic material, attaching said ring to said slide, and fitting said ring around said length of PVC and said rigid relief artistic material and fitting said slide in said track wherein said ring has an inner diameter sufficiently large so as not to interfere with said rigid relief artistic material when said ring is filled around said PVC and said ring is moved by said slide along said track.

3. The method of claim 2 wherein said support member is a commercially available J-hook having an arcuate surface and said PVC is positioned in said arcuate surface of said J-hook.

4. The method of claim 2 wherein said method includes the further steps of providing a PVC fitting having two ends, applying relief decoration to one of said first end and said second end of said fitting to make a finial, and attaching the other end of said fitting to said end of said PVC.

5. The method of claim 2 wherein said PVC is oriented within said support member with said track concealed from view by one standing before a window decorated with said drapery rod, and said means for preventing rotation retaining said orientation of said PVC so as to maintain said track concealed from view.

* * * * *